US012655364B2

(12) United States Patent
Smith et al.

(10) Patent No.: US 12,655,364 B2
(45) Date of Patent: Jun. 16, 2026

(54) PROCESS FOR RECYCLING A CIRCULAR HYDROCARBON FROM A USED HIGH PERFORMANCE LUBRICANT

(71) Applicant: ExxonMobil Technology and Engineering Company, Baytown, TX (US)

(72) Inventors: Jordan C. Smith, Spring, TX (US); Bennett D. Marshall, II, Conroe, TX (US); Pavel V. Kortunov, Flemington, NJ (US); Joseph E. Gatt, Annandale, NJ (US); Mohammed I. L. Abutaqiya, League City, TX (US); Theresa Lindsey Bunting, Houston, TX (US); Yunlong Zhang, Cypress, TX (US); Brian D. Hogg, Swarthmore, PA (US); Joseph Chan, Sarnia (CA); Christopher J. Wheeler, Sarnia (CA)

(73) Assignee: ExxonMobil Technology and Engineering Company, Baytown, TX (US)

( * ) Notice: Subject to any disclaimer, the term of this patent is extended or adjusted under 35 U.S.C. 154(b) by 0 days.

(21) Appl. No.: 19/041,625

(22) Filed: Jan. 30, 2025

(65) Prior Publication Data

US 2025/0270468 A1 Aug. 28, 2025

Related U.S. Application Data

(60) Provisional application No. 63/749,493, filed on Jan. 25, 2025, provisional application No. 63/556,528, filed on Feb. 22, 2024.

(51) Int. Cl.
*C10M 175/00* (2006.01)
*C10M 107/02* (2006.01)
(Continued)

(52) U.S. Cl.
CPC ..... *C10M 175/005* (2013.01); *C10M 107/02* (2013.01); *C10M 2205/0206* (2013.01); *C10N 2020/02* (2013.01); *C10N 2070/00* (2013.01)

(58) Field of Classification Search
CPC ..... C10M 175/005; C10M 107/02; C10M 2205/0206; C10N 2020/02; C10N 2070/00; C10G 21/20; C10G 2300/1007
See application file for complete search history.

(56) References Cited

U.S. PATENT DOCUMENTS 4,827,064 A 5/1989 Wu
4,827,073 A 5/1989 Wu
(Continued)

FOREIGN PATENT DOCUMENTS

CN 107474933 A 12/2017
KR 102049750 * 11/2019
(Continued)

OTHER PUBLICATIONS

Bay Oils Ltd, Wind Farm Oil Collection—Turbine Oil Collection (2021-2025—according to Wayback Machine) (Year: 2021).*
(Continued)

*Primary Examiner* — Cephia D Toomer
(74) *Attorney, Agent, or Firm* — Vorys, Sater, Seymour and Pease LLP

(57) ABSTRACT

Provided herein are processes for recycling hydrocarbons in a used high performance lubricant such as wind turbine gear oil. In the present process and methodologies, the used high performance lubricant is not mixed with another type of used oil. The used high performance oil is contacted with a solvent in an extraction process. Contaminates are extracted and circular hydrocarbons are formed. Solvent can be recovered, and the circular hydrocarbon combined with a high
(Continued)

performance base stock for use as a high performance lubricant in a mechanical system.

12 Claims, 1 Drawing Sheet

(51) Int. Cl.
*C10N 20/02* (2006.01)
*C10N 70/00* (2006.01)

(56) References Cited

U.S. PATENT DOCUMENTS

| | | | | |
|---|---|---|---|---|
| 4,956,122 | A | 9/1990 | Watts et al. | |
| 6,117,309 | A | 9/2000 | Daspit et al. | |
| 7,704,930 | B2 | 4/2010 | Deckman et al. | |
| 8,366,912 | B1 | 2/2013 | Macdonald | |
| 2009/0184030 | A1* | 7/2009 | Yen | C10G 21/02 208/180 |
| 2011/0082061 | A1 | 4/2011 | Carey et al. | |
| 2014/0038867 | A1 | 2/2014 | Baker et al. | |
| 2017/0130143 | A1 | 5/2017 | Macdonald | |
| 2023/0159852 | A1* | 5/2023 | Zielinski | C10M 175/0033 508/111 |

FOREIGN PATENT DOCUMENTS

| | | | |
|---|---|---|---|
| WO | 2011/041647 | A1 | 4/2011 |
| WO | 2020/264534 | A2 | 12/2020 |
| WO | 2025/178738 | A1 | 8/2025 |

OTHER PUBLICATIONS

Ghadiri, Emad Solvent Extraction of Used Engine Oil: Process, Types, Innovations, Jan. 14, 2024, INVEXOIL.com (Year: 2024).*
Singh, Dilip et al., Study and analysis of wind turbine gearbox lubrication failure and its mitigation process, (2021) Materials Today: Proceedings (Year: 2021).*
International Search Report and Written Opinion received for PCT Application No. PCT/US2025/013818, mailing date May 1, 15, 2025, 11 Pages.

* cited by examiner

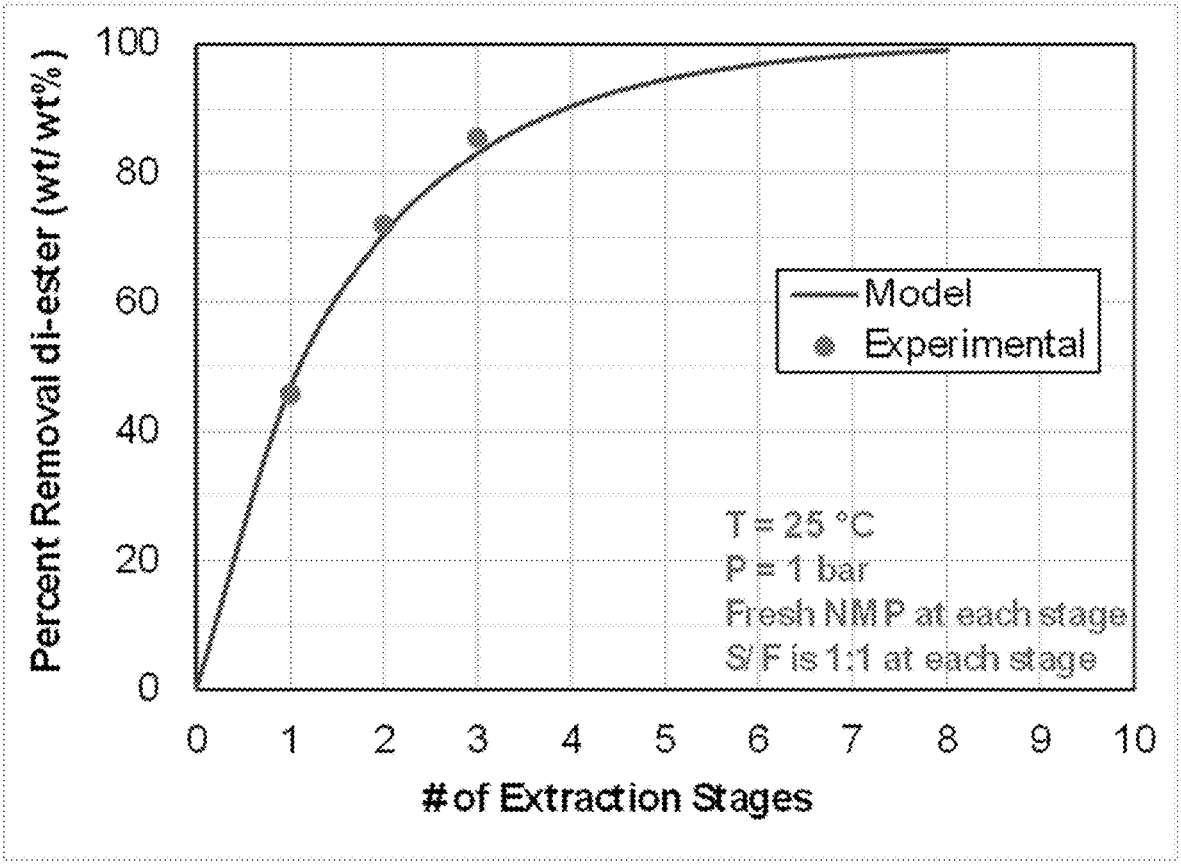
Percent Removal di-ester (wt/wt%)
100
80
60
40
20
0
0
1
2
3
4
5
6
7
8
9
10
# of Extraction Stages
Model
Experimental
T = 25 °C
P = 1 bar
Fresh NMP at each stage
S/F is 1:1 at each stage

PROCESS FOR RECYCLING A CIRCULAR HYDROCARBON FROM A USED HIGH PERFORMANCE LUBRICANT

CROSS-REFERENCE TO RELATED APPLICATIONS

This application claims the benefit of U.S. Provisional Application No. 63/556,528, filed on Feb. 22, 2024, and U.S. Provisional Application No. 63/749,493, filed on Jan. 25, 2025, the entire contents of which is incorporated herein by reference.

FIELD

The present disclosure relates to recycling hydrocarbons in used oil for use in a mechanical system.

BACKGROUND

High performance lubricants are replaced in a mechanical system when the oil becomes contaminated, or additives depleted. Lubricants are also often replaced because of a recommended oil drain interval or oil conditioning monitoring systems identify an issue that requires changing the oil. Regardless of the reason, high performance lubricants contain high viscosity, high-quality hydrocarbons, such as polyalphaolefin, which typically make up 60 to 99% of the replaced lubricant but often are not degraded at the time.

Regardless of its composition, disposition of a used lubricant typically results in one of two main pathways. First, used oil can be burned as an additional source of energy. Second, used oil is re-refined into a low viscosity API Grp I, II or III base stock. For high performance lubricants, such as those comprising polyalphaolefin as the base stock, this pathway produces a downgrade in the type of lubricant produced.

SUMMARY

Provided herein are processes for recycling hydrocarbons in a high performance lubricant comprising the steps of: a) providing a used high performance lubricant comprising a hydrocarbon and a contaminate; b) contacting the used oil with a liquid phase; c) extracting the contaminate from the used oil into an extract phase to produce a raffinate phase comprising the hydrocarbon and the solvent; d) repeat steps b) and c) at least three times to remove the contaminate from the used oil; e) separating the extract phase and the raffinate phase; and f) separating the solvent from the raffinate phase to form what could be considered a circular hydrocarbon. The circular hydrocarbon is then blended with one or more base stocks. In the present processes, the used oil is not combined or mixed with another type of used oil. In an embodiment, the liquid phase is a solvent.

Also provided are methods of recycling hydrocarbons from a wind turbine gear oil comprising the steps of: providing a used wind turbine gear oil to a multi-stage liquid-liquid extraction unit without mixing the wind turbine gear oil with another type of used oil; mixing the used wind turbine gear oil with a solvent wherein two immiscible phases of liquid are produced; separating the immiscible phases of liquid into an extract phase and a raffinate phase; separating hydrocarbons from the solvent in the raffinate phase to produce an extraction product. A suitable diluent for the used oil may be included so as to improve the efficiency of the extraction. The extraction unit comprises at least 3 stages of liquid-liquid extraction. The extraction product is combined with one or more base stocks to produce a high performance lubricant.

BRIEF DESCRIPTION OF THE DRAWINGS

To assist those of ordinary skill in the relevant art in making and using the subject matter hereof, reference is made to the appended drawings, wherein:

The FIGURE is a graph of the thermodynamic modeling of the NMP extraction of used oil as described in Example 1.

DETAILED DESCRIPTION

Before the present compounds, components, compositions, and/or methods are disclosed and described, it is to be understood that unless otherwise indicated this disclosure is not limited to specific compounds, components, compositions, reactants, reaction conditions, ligands, catalyst structures, metallocene structures, or the like, as such may vary, unless otherwise specified. It is also to be understood that the terminology used herein is for the purpose of describing aspects only and is not intended to be limiting.

All numerical values within the detailed description and the claims herein are modified by "about" or "approximately" the indicated value, taking into account experimental error and variations.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

For the purposes of this disclosure, the following definitions will apply:

The numbering scheme for the Periodic Table Groups is according to the IUPAC Periodic Table of Elements as of Jan. 1, 2020.

As used herein, the term "and/or" as used in a phrase such as "A and/or B" herein is intended to include "A and B", "A or B", "A", and "B".

The term "alpha-olefin" refers to an olefin having a terminal carbon-to-carbon double bond ($(R_1R_2)—C{=}CH_2$) in the structure thereof.

The term "aromatic" refers to unsaturated hydrocarbons comprising an aromatic ring in structures thereof, the aromatic ring having a delocalized conjugated .pi. system and having from 4 to 20 carbon atoms. The aromatic ring can comprise one or more heteroatoms and can be monocyclic, bicyclic, tricyclic, and/or polycyclic and can be fused rings. Aromatics can be measured by one or more of several methods, including supercritical fluid chromatography (ASTM D5186), high-pressure liquid chromatography (HPLC) (ASTM D6379), chromatography over alumina/silica gel (ASTM D2549), preparative chromatography (ASTM D2007), and ultraviolet (UV) spectroscopy.

The term "base stock" is a single lubricant component produced by a single manufacturer to the same specifications, meets the same manufacturer's specification, and is identified by a unique formula, product identification number or both. American Petroleum Institute (API) 1509, Engine Oil Licensing and Certification System, 15th ed., April 2002, Appendix E. API Base Oil Interchangeability Guidelines for Passenger Cr Motor Oils and Diesel Engine Oils, 2004, Section E.1.2, Definitions (Washington, DC: American Petroleum Institute).

The term "high performance base stock" means and includes a Group III base stock such as a GTL (gas to liquid) or mixtures thereof and/or a Group IV base stock. As described herein, the Group IV base stock includes one or more polyalphaolefins and mixtures thereof.

As used herein, a "contaminate" is a degraded additive or degraded product induced by oxidation or shear stress, or reaction products from contacting with metal, water/moisture, and air/oxygen.

As used herein, the term "lubricant" or "formulated lubricant" refers to a substance that can be introduced between two or more moving surfaces and lowers the level of friction between two adjacent surfaces moving relative to each other and includes, but is not limited to, a gear oil formulation. The lubricant (also referred to as a formulated lubricant) comprises one or more base stocks and one or more additives.

As used herein, the term "high performance lubricant" includes, but is not limited to, wind turbine gear oil, engine oils such as lubricating oils for spark ignition and diesel ignition engines, driveline oils such as transmission fluids and gear oils, and industrial oils such as circulating oils or hydraulic oils.

As described herein, the high performance lubricant comprises one or more high performance base stocks or one or more Group III base stocks and/or one or more Group IV base stocks or mixtures thereof.

As used herein, the term "additive package" refers to a combination of two or more additives in a lubricant.

Unless otherwise specified, the term "hydrocarbon" refers to a class of compounds containing hydrogen bound to carbon, and encompasses (i) saturated hydrocarbon compounds, (ii) unsaturated hydrocarbon compounds, and (iii) mixtures of hydrocarbon compounds (saturated and/or unsaturated), including mixtures of hydrocarbon compounds having different values of n.

The term "olefin" refers to an unsaturated hydrocarbon compound having a hydrocarbon chain containing at least one carbon-to-carbon double bond in the structure thereof and the carbon-to-carbon double bond does not constitute a part of an aromatic ring. The olefin can be straight-chain, branched-chain or cyclic. As used herein, the term "olefin" is intended to embrace all structural isomeric forms of olefins, unless specified as a single isomer.

The term "polyalphaolefin(s)" or "PAO(s)" includes any oligomer(s) and polymer(s) of one or more alpha-olefin monomer(s). Thus, the PAO can be a dimer, a trimer, a tetramer, or any other oligomer or polymer comprising two or more structure units derived from one or more alpha-olefin monomer(s) and can be highly regio-regular, such that the bulk material exhibits an isotacticity, or a syndiotacticity when measured by $^{13}C$ NMR. The PAO molecule can be highly regio-irregular, such that the bulk material is substantially atactic when measured by $^{13}C$ NMR. A PAO material made by using a metallocene-based catalyst system is typically called a metallocene-PAO ("mPAO"), and a PAO material made by using traditional non-metallocene-based catalysts (e.g., Lewis acids, supported chromium oxide, and the like) is typically called a conventional PAO ("cPAO").

The term "PAO," in the singular or in the plural, is used interchangeably herein with the term Group IV base stock.

The term "viscosity index" or "VI" is a measure of the extent of viscosity change with temperature; the higher the VI, the less change, and generally speaking, higher VIs are preferred. VI is usually calculated from measurements at 40° C. and 100° C. A viscosity index is an empirical, unitless number which indicates the rate of change in the viscosity of an oil within a given temperature range and measured by ASTM D2270.

The term "pour point" is the temperature at which a base stock no longer flows. For paraffinic base stocks, pour points are between about −12° C. and about −15° C., as determined by operation of the dewaxing unit. For specialty purposes, pour points are often lower. The pour points of naphthenic base stocks, which have low wax content, pour points can range between −30° C. to −50° C. For very viscous base stocks such as Bright stocks, pour points often reflect a viscosity limit. Pour points are measured by ASTM D97.

The term "sulfur" includes elemental sulfur and sulfur-containing compounds such as thiols, sulfides, thiophenes, benzo- and dibenzo-thiophenes, and more complex structures.

As used herein, the term "used oil" means and includes a used high performance lubricant such as wind turbine gear oil that has been previously used in lubricating service to reduce friction between adjacent surfaces or as a heat transfer fluid.

As used herein, the term "circular hydrocarbon" means and includes hydrocarbon fluids (i.e., lubricants) at the beginning of the supply chain considered as a waste, but instead reused, further used, or recycled in a loop without dropping out of the economy.

As described herein, processes for recycling hydrocarbons in a used oil are provided. The used oil comprises a hydrocarbon and one or more contaminates. In an embodiment, the used oil is a high performance lubricant where one or more additives have been depleted. The used high performance lubricant (sometimes referred to as a "used high performance base oil" or a "used high performance oil") comprises a hydrocarbon and one or more contaminates. The used high performance lubricant has one or more additives depleted or oxidized. For example, an additive can be depleted by decomposition or breakdown, adsorption onto a metal, particle, and water surfaces, and/or due to separation of the additive from the base oil due to settling or filtration and the like. For many additives, the longer the lubricant remains in service, the less effective the additives are in protecting equipment. When an additive package weakens, viscosity increases, sludge can form, corrosive acids can attack bearing and other metal surfaces and/or wear begins to increase.

In the present processes, the used high performance lubricant is contacted with a solvent. The contaminate is extracted from the used oil into an extract phase to produce a raffinate phase comprising the hydrocarbon and the solvent. The used high performance lubricant is subject to extraction at least three times (or in three stages) to remove the contaminate from the used oil. The extract phase and the raffinate phase are then separated. The solvent is separated from the raffinate phase to form a circular hydrocarbon. The circular hydrocarbon is blended with one or more base stocks. The base stock is subsequently combined with one or more additives to produce a formulated lubricant.

In the present processes, the used oil is not combined or mixed with another type of used oil. For example, the used high performance oil is only combined with another used high performance oil of similar quality. Recycled hydrocarbons are not burned as an energy source or used to make a lower quality base stock. Rather, in the present process, circular hydrocarbons are combined with one or more base stocks to provide a high performance lubricant useful in various applications such as a wind turbine gear oil.

Contaminates in the used oil include degraded additives and oxidation by-products. In the present process, the contaminates are separated from used oil. In one embodiment, the process is continuous. Solvent is recovered from the extract phase when the extract phase is fed to a distillation column or other known separation device.

Therefore, a key feature of the present process and methodologies is that used oil is not mixed or otherwise combined with another type of used oil (another used lubricant). In other words, this methodology is performed without combining used lubricants which is particularly important for wind turbine gear oils. Wind turbine gear oil is a high performance lubricant and comprises between 65 percent and 95 percent polyalphaolefin ("PAO").

The present methods of recycling hydrocarbons from wind turbine gear oil comprising the steps of: providing used wind turbine gear oil to a multi-stage liquid-liquid extraction unit without mixing the wind turbine gear oil with another type of used oil such as lower grade lubricants and oil. The extraction unit comprises at least 3 stages of liquid-liquid extraction and preferably 5 stages. Used wind turbine gear oil is mixed with a solvent where two immiscible phases of liquid are formed. The immiscible phases of liquid into an extract phase and a raffinate phase. Hydrocarbons from the solvent in the raffinate phase are separated from the solvent to produce an extraction product. The extraction product can be subsequently combined with the high performance base stock, or directly combined into a high performance lubricant. In an embodiment, solvent is recovered and recycled.

Base Stocks

A base stock is a single component of a lubricant. The base stock is a single product, usually defined by its viscosity grade. Base stocks are generally classified as naphthenic and paraffinic, depending on what type of crude was used in producing the base stock. Naphthenic crudes are characterized by the absence of wax or have very low levels of wax. Therefore, naphthenic crudes are largely cycloparaffinic and aromatic in composition. Furthermore, naphthenic lube fractions without any dewaxing are generally liquid at low temperatures. On the other hand, paraffinic crudes contain wax, and are largely of n- and iso-paraffins which have high melting points.

The base stock can be a natural oil, bio derived, a combination of natural oils, or synthetic. Natural oils (or mixtures thereof) can be used unrefined, refined, or re-refined (the latter is also known as reclaimed or reprocessed oil). Unrefined oils are those obtained directly from a natural source and used without added purification. These include shale oil obtained directly from retorting operations, petroleum oil obtained directly from primary distillation, and ester oil obtained directly from an esterification process. Refined oils are like unrefined oils except refined oils are subjected to one or more purification steps to improve the at least one lubricating oil property.

API Group I, Group II, Group III, Group IV, and Group V base stocks are broad categories of base stocks. See e.g., API Publication 1509. Group I base stocks generally have a viscosity index of from 80 to 120 and contain greater than 0.03% sulfur and less than 90% saturates. Group II base stocks generally have a viscosity index of from 80 to 120 and contain less than or equal to 0.03% sulfur and greater than or equal to 90% saturates. Group III base stocks generally have a viscosity index greater than 120 and contain less than or equal to 0.03% sulfur and greater than 90% saturates. Group IV base stocks comprise PAOs. Group V base stocks include base stocks not included in Groups I-IV. Group V base stocks are often blended with other base oils to affect the finished lubricant properties.

Table 1 below summarizes properties of each of these five groups.

TABLE 1

| Base Stock Properties | | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | PAOs and PAO products | | |
| Group V | All other base stocks not included in Groups I, II, III, or IV | | |

Not all base stocks within a given API Group can be expected to provide the same level of performance in a formulated lubricant.

High performance base stocks include Group III$^+$ base stock and Group IV base stock. Group IV base stock is sometimes referred to as a polyalphaolefin ("PAO") base stock. By way of example, PAOs derived from C8, C10, C12, C14 olefins or mixtures thereof can be used in a Group IV base stock. See U.S. Pat. Nos. 4,956,122; 4,827,064; and 4,827,073.

The Group III base stock has a viscosity index (ASTM D2270-16) from 120 to 140, or 140 to 160, or 160 to 180, or 180 to 200, or 100 to 200, or 150 to 200, or 80 to 150, encompassing any value and subset therebetween. The Group IV base stock has a viscosity index of greater than about 130, greater than about 135, greater than about 140, between about 130 and about 180, and between about 130 and 160.

As described herein, a high performance base stock can have a kinematic viscosity (ASTM D445-21, 100° C.) (KV100) between about 4 cSt and about 300 cSt. In an embodiment, the high performance base stock has a kinematic viscosity (ASTM D445-21, 100° C.) (KV100) between about 4 cSt to about 10 cSt, 5 cSt to about 9 cSt, or 6 cSt to about 8 cSt. In an embodiment, the high performance base stock has a kinematic viscosity (ASTM D445-21, 100° C.) (KV100) between about 40 cSt and about 300 cSt, or about 50 cSt and about 250 cSt, or about 60 cSt and about 200 cSt. The high performance base stock has a pour point (IP 15 or ASTM D97) from −78° C. to −20° C., or −35° C. to −60° C., or −40° C. to −60° C. The high performance base stock has a viscosity index (ASTM D2270-16) between about 120 to 230, or 150 to 200, or 150 or greater.

As described herein, a high performance lubricant comprises the high performance base stock in an amount between about 60 wt. % to about 99.5 wt. % by total weight of the high performance lubricant, or between 70 wt. % to 99.5 wt. %, or between 70 wt. % to 95, or between 80 wt. % to 95 wt. %, or between 80 wt. % to 94 wt. %, or between 80 wt. % to 93 wt. %, or between 85 wt. % to 94 wt. % by total weight of the high performance lubricant. The high performance lubricant has a pour point (ASTM 97) from −70° C. to −20° C., encompassing any value and subset therebetween.

Polyalphaolefins

As described herein, the high performance base stock can be conventional PAO and/or a metallocene PAO. Generally, PAOs are manufactured through a synthetic chemical process that originates from ethylene produced by cracking either crude oil or natural gas. Polyalphaolefins produced in and exiting from a reactor are olefins. Downstream hydrogenation converts polyalphaolefins into hydrogenated PAO that do not contain ring structures, double bonds, sulfur, nitrogen components or waxy hydrocarbons. The absence of these structures and materials results in a non-polar base oil having a relatively high viscosity index, excellent low-temperature flow and pour-point characteristics, good oxidation stability and compatibility with mineral oils, paints and seals commonly found in lube oil systems. Because of the hydrogenated structure, PAOs do not contain lighter, more volatile (small) hydrocarbons, lowering volatility, raising the flash point, and create less hydrocarbon tailpipe emissions.

Conventional polyalphaolefins ("cPAOs") are homopolymers made from a single linear alphaolefin ("LAO"), typically LAO8, LAO10, or LAO12. Conventional PAOs can also be copolymers made from two or more alphaolefins, typically LAO8, LAO10, or LAO12. Typically, the kinematic viscosity at 100° C. ranges from 1.5 to 100. The viscosity index of the conventional PAO ranges from 1.5 to 100. Conventional PAOs can be produced using a $BF_3$ catalyst system.

Metallocene polyalphaolefins ("mPAOs") are a co-polymer made from at least two alpha-olefins or more, or a homo-polymer made from a single alpha-olefin feed, or a homo-polymer made from a single alpha-olefin feed by a metallocene catalyst system. WO2011/041647 at ¶ [0026]. In an embodiment, the activated metallocene catalyst used to produce the PAOs can be a simple metallocene, substituted metallocene or bridged metallocene catalyst activated or promoted by, for instance, methylaluminoxane (MAO) or a non-coordinating anion, such as N,N-dimethylanilinium tetrakis(perfluorophenyl)borate or other equivalent non-coordinating anion and optionally with co-activators, typically trialkylaluminum compounds. WO2011/041647 at ¶ [0031].

The copolymer mPAO composition is made from at least two alphaolefins of C2 to C30 range and having monomers randomly distributed in the polymers. It is preferred that the average carbon number is between C30 and C100. The copolymers can be isotactic, atactic, syndiotactic polymers or any other form of appropriate tacticity.

Hybrid PAO is another class of PAO. Hybrid PAO is produced by combining a metallocene process step with a conventional $BF_3$ process step. For example, in the metallocene process step, a single LAO (C6, C8, C10, C12, C14, or C16) is dimerized to a LAO dimer olefin. This dimer plus other LAO monomers are fed into a $BF_3$ reactor where they are copolymerized to produce the hybrid PAOs.

Additives

As provided herein, the lubricant (as a neat oil) contains one or more of additives including but not limited to antioxidants, dispersants, antiwear agents, extreme pressure additives, anti-seizure agents, wax modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. See e.g., WO 2020/264534 A2 at [0092]-[0237]. For a review of commonly used additives, see Klamann in Lubricants and Related Products, Verlag Chemie, Deerfield Beach, FL; ISBN 0-89573-177-0. Reference is also made to "Lubricant Additives" by M. W. Ranney, published by Noyes Data Corporation of Parkridge, NJ (1973); see also, U.S. Pat. No. 7,704,930 at [0049] to [0103]. These additives are commonly delivered with varying amounts of diluent oil, that may range from 5 weight percent to 50 weight percent.

The types and quantities of performance additives used in combination with the instant disclosure are not limited by the examples shown herein as illustrations. For example, the gear oil formulations comprise one or more additives including, but not limited to, an ashless dispersant, a pour point depressant, an antifoaming agent, an antioxidant, a rust inhibitor, a friction modifier, a viscosity index improver, and the like, and any combination thereof to satisfy diversified characteristics (e.g., those related to friction, oxidation stability, cleanness, defoaming, viscosity, and the like).

Ashless dispersants for use in the gear oil formulations include, but are not limited to, those based on polybutenyl succinic acid imide, polybutenyl succinic acid amide, benzylamine, succinic acid ester, succinic acid ester-amide and a boron derivative thereof, and the like, and any combination thereof. When included, the ashless dispersants may be included in the gear oil formulation from 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), by total weight of the gear oil formulation.

Pour point depressants include, but are not limited to, ethylene/vinyl acetate copolymer, condensate of chlorinated paraffin and naphthalene, condensate of chlorinated paraffin and phenol, polymethacrylate, polyalkyl styrene, and the like, and any combination thereof. When included, the pour point depressants are present in the amount between 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %) by total weight of the gear oil formulation. It is to be further noted that the gear oil formulations can be formulated such that a pour point depressant is not required to maintain the pour point of the gear oil below −20° C. That is, the pour point of the gear oil is maintained below −20° C. or lower in the absence of a pour point depressant.

Antifoaming agents for use in the gear oil formulations of the present invention include, but are not limited to, dimethyl polysiloxane, polyacrylate and a fluorine derivative thereof, perfluoropolyether, and the like, and any combination thereof. When included, the antifoaming agents are present in the amount between 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %) by total weight of the gear oil formulation.

Antioxidants for use in the gear oil formulations of the present invention include, but are not limited to, amine-based antioxidants (e.g., alkylated diphenylamine, phenyl-α-naphthylamine and alkylated phenyl-x-naphtylamine); phenol-based antioxidants (e.g., 2,6-di-t-butyl phenol, 4,4'-methylenebis-(2,6-di-t-butyl phenol) and isooctyl-3-(3,5-di-t-butyl-4-hydroxyphenyl) propionate); sulfur-based antioxidants (e.g., dilauryl-3,3'-thiodipropionate); zinc dithiophosphate, and the like, and any combination thereof. When included, the antioxidants are present in an amount between 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), by total weight of the gear oil formulation.

Rust inhibitors for use in the gear oil formulations of the present invention include, but are not limited to, a fatty acid, alkenylsuccinic acid half ester, fatty acid soap, alkylsulfonate, polyhydric alcohol/fatty acid ester, fatty acid amine, oxidized paraffin, and alkylpolyoxyethylene ether, and the like, and any combination. When included, the rust inhibitors may be included in the gear oil formulation from 0.05 wt. % to 5 wt. % (or 0.05 wt. % to 0.1 wt. %, or 0.5 wt. % to 1 wt. %, or 15 1 wt. % to 2 wt. %, or 2 wt. % to 4 wt. %, or 2.5 wt. % to 5 wt. %) by total weight of the gear oil formulation.

Friction modifiers for use in the gear oil formulations of the present invention include, but are not limited to, an organomolybdenum-based compound, fatty acid, higher alcohol, fatty acid ester, oil/fat, amine, polyamide, sulfide ester, phosphoric acid ester, acid phosphorric acid ester, acid phosphorous acid ester, amine salt of phosphoric acid ester, and the like, and any combination thereof. When included, the friction modifiers may be included in the gear oil formulation from 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %) by total weight of the gear oil formulation.

Viscosity index improvers for use in the gear oil formulations of the present disclosure may include, but are not limited to, polyisobuylene, polymethacrylate, olefin copolymers (e.g., ethylene-propylene copolymers, ethylene-propylene diene-modified copolymers (EPDMs), and the like), hydrogenated styrenic block copolymers (e.g., styrene-ethylene/butylene-styrene copolymer (SEBS), and the like), and the like, and any combination thereof. When included, the viscosity index improvers are present in an amount between 0.05 wt. % to 5 wt. % (or 0.05 wt. % to 0.1 wt. %, or 0.5 wt. % to 1 wt. %, or 1 wt. % to 2 wt. %, or 2 wt. % to 4 wt. %, or 2.5 wt. % to 5 wt. %), by total weight of the gear oil formulation.

Lubricants—Wind Turbine Gear Oil

As provided herein, the high performance lubricant contains high performance base stock in an amount between about 60 wt. % to about 99.5 wt. % by total weight of the high performance lubricant, or between 70 wt. % to 99.5 wt. %, or between 70 wt. % to 95, or between 80 wt. % to 95 wt. %, or between 80 wt. % to 94 wt. %, or between 80 wt. % to 93 wt. %, or between 85 wt. % to 94 wt. % by total weight of the high performance lubricant.

High performance lubricants include gear oils and are used in the automotive, industrial, or marine industries in gearboxes, transmissions, differentials, transaxles, and transfer cases and the like. Gear oils contain two basic components, namely, base stock and additives. Gear oils help drive trains run smoothly and protect internal gear systems from heat and wear damage. Inadequate lubrication results in pitting (e.g., micropitting), corrosion, scouring, scuffing, and/or other damage to the gear box. Gear oils have a higher viscosity compared to other lubricating oil, such as engine oil. The high viscosity of the gear oil permits rotational movement, sliding movement, or other frictional movement between machine or equipment parts. As used herein, a gear oil comprises at least one base stock and at least one additive. The gear oil typically comprises two or more blended base stock and a plurality (two or more) of additives.

Gear oil is useful as high performance lubricant in applications such as a lubricating gearbox, a transmission, a differential, a transaxle, and a transfer case in the automotive, industrial, and marine industries. In an embodiment, the gear oil comprises Group IV base stock in an amount between about 65 wt. % to about 90 wt. % of the lubricant (sometimes referred to herein as a "gear oil formulation") or 65 wt. % to 85 wt. %, or 65 wt. % to 80 wt. %, or 65 wt. % to 75 wt. %, or 65 wt. % to 70 wt. % by total weight of the high performance lubricant.

In an embodiment, the gear oil is used in the gearbox (e.g., main gearbox) of a wind turbine, referred to herein as "wind turbine gear oil." The wind turbine gear oil, a high performance lubricant, typically includes at least one Group IV base stock, Group III base stock, and an optional Group V base stock. Further, the wind turbine gear oil may comprise one or more additives.

As provided herein, the wind turbine gear oil comprises high performance base stock(s) in an amount from 60 wt. % to 99.5 wt. % or 65 wt. % to 95 wt. %, or 65 wt. % to 90 wt. %, or 65 wt. % to 85 wt. %, or 65 wt. % to 80 wt. %, or 65 wt. % to 75 wt. %, or 70 wt. % to 90 wt. %, or 80 wt. % to 85 wt. %, by total weight of the wind turbine gear oil.

The wind turbine gear oil often comprises an API Group III base stock and/or Group IV base stock. Further, the wind turbine gear oil can be formulated such that no viscosity index improver is required to maintain the viscosity index of the wind turbine gear oil in the range described below (greater than or equal to 150). That is, the viscosity index of the wind turbine gear oil is maintained at greater than or equal to 150 in the absence of a viscosity index improver.

The wind turbine gear oil comprises PAO including, for example, conventional PAO (light or heavy), metallocene PAO (mPAO) and combinations thereof. In some embodiments, the PAO is a mPAO or combination of mPAO. Examples of suitable mPAOs include, but are not limited to, mPAO 300, mPAO 150, mPAO 65, and combinations thereof.

PAO has a kinematic viscosity (ASTM D445, 40° C.) between 10 $mm^2/s$ to 3500 $mm^2/s$ (or 500 $mm^2/s$ to 1000 $mm^2/s$, or 1000 $mm^2/s$ to 1500 $mm^2/s$, or 1500 $mm^2/s$ to 2000 $mm^2/s$, or 2000 $mm^2/s$ to 2500 $mm^2/s$, or 2500 $mm^2/s$ to 3000 $mm^2/s$, or 3000 $mm^2/s$ to 3500 $mm^2/s$, or 1000 $mm^2/s$ to 2500 $mm^2/s$); and a kinematic viscosity (ASTM D445-21, 100° C.) between 6 $mm^2/s$ to 300 $mm^2/s$ (or 40 $mm^2/s$ to 300 $mm^2/s$, or 65 $mm^2/s$ to 300 $mm^2/s$, or 150 $mm^2/s$ to 300 $mm^2/s$, or 6 $mm^2/s$ to 10 $mm^2/s$, or 8 $mm^2/s$ to 10 $mm^2/s$). PAO has a viscosity index (ASTM D2270-16) between 120 to 250 (or 150 to 165, or 170 to 200, or 175 to 180, or 200 to 250, or 10 170 to 250). PAO has a pour point (IP 15 or ASTM D97) between −70° C. to −15° C. (or −45° C. to −30° C., or −45° C. to −39° C.).

The wind turbine gear oil (high performance lubricant) has a kinematic viscosity (ASTM D445-21, 100° C.) between 200 $mm^2/s$ and 680 $mm^2/s$ (or 320 $mm^2/s$ and 520 $mm^2/s$, or 380 $mm^2/s$ and 520 $mm^2/s$, or 450 $mm^2/s$ 520 $mm^2/s$) with between 220 $mm^2/s$ and 460 $mm^2/s$ being most common.

The wind turbine gear oil has an acid number at pH 11.0 (ASTM D2893) of from 0.2 mgKOH/g to 1.0 mgKOH/g (or 0.5 mgKOH/g to 1.0 mgKOH/g, or 0.5 mgKOH/g to 0.6 mgKOH/g, or 0.6 mgKOH/g to 0.7 mgKOH/g, or 0.7 mgKOH/g to 0.8 mgKOH/g, or 0.8 mgKOH/g to 0.9 mgKOH/g, or 0.9 mgKOH/g to 1.0 mgKOH/g). The wind turbine gear oil has an oxidation D91 precipitation number in the range of less than 0.025 mL, including 0 mL, encompassing any value and subset therebetween. The wind turbine gear oil has a viscosity index (ASTM D2270-16) from 120 to 200 (or 120 to 130, or 140 to 160, or 160 to 180, or 160 to 170), encompassing any value and subset therebetween.

The wind turbine gear oil has a pour point (IP 15 or ASTM D97) of from −65° C. to −20° C. or −45° C. to −30° C., or −45° C. to −39° C., encompassing any value and subset therebetween. The gear oil formulations of the present disclosure accordingly are competitive with fully synthetic gear oil formulations, even without a pour point depressant. Moreover, the gear oil formulations of the present disclosure exhibit advantages in pressure viscosity coefficient and cost. It is further believed, without being bound by theory, that the gear oil formulations further improve elastohydrodynamic lubrication (EHL) film thickness (resulting in a thicker EHL film), thus critically improving gear life and pitting (e.g., micropitting) performance compared to convention gear oil formulations (e.g., conventional PAO-based gear oils).

Different properties of the wind turbine gear oil can be achieved through blending the different components. The wind turbine gear oil can have an equivalent viscosity index (VI) and low temperature properties compared to conventional PAO gear oils and can perform to the same level of neat conventional PAO formulations and other synthetic oils.

Used Oil

As described herein, the used oil is an untreated, used lubricant, or a pre-treated, used lubricant, or a combination thereof. The pre-treated used oil is a used lubricant that has been exposed to one or more processes for removal of one or more components and/or contaminants. The used oil can also be diluted with another solvent to reduce the viscosity. The diluent should be miscible with used oil without phase separation, which can be removed with distillation and recycled. Preferably, a $C_7$ heptane solvent or other light alkane is used (i.e., hexane, cyclohexaneoctane, naphtha, gasoline or similar). Preferably, the diluent is in an amount of 20-80 wt %.

Examples of components and/or contaminants that can be removed during a pre-treatment process include, but are not limited to, metals, water, ethylene glycol, and other non-hydrocarbon species that may be present in a used oil. Examples of pre-treatment processes include, but are not limited to, metal extraction processes, water extraction processes, caustic treatment processes, and ethylene glycol removal processes. It is noted that sufficient pre-treatment may be performed to reduce the content of metals, ethylene glycol, and water, or the pre-treatment may reduce the content of one or more contaminants while allowing other contaminants to remain substantially at or near the amount present in the untreated used lubricant oil.

As provided herein, the used high performance lubricant has a relatively high viscosity index due, in part, to the viscosity index of the underlying base stock in the used oil and due, in part, to the presence of one or more additives that can enhance the viscosity index of the lubricant. More specifically, the used oil has a viscosity index of 130 or more. For example, the viscosity index can be 130 to 200, or 130 to 120, or 130 to 170, or 130 to 160, or 130 to 150 for used oil including additives and contaminates.

Additionally or alternatively, base stock in the used high performance lubricant has a viscosity index of 120 or more. For example, the viscosity index of the base stock in the used oil has 120 to 200, or 120 to 190 or 120 to 180 or 120 to 170. In an embodiment, the base stock in the used high performance lubricant has a viscosity index of 120 or greater.

Extraction—Multistage

The processes disclosed herein are useful in processing used oils such high-performance lubricant including wind turbine gear oil ("WTGO"), engine oil, industrial oil, grease and the like. The present processes use solvent extraction (also referred to as "liquid-liquid extraction"). In the extraction process, partitioning separates compounds based on their relative solubilities, for example, in at least two immiscible liquids or phases. The contaminates in the used oil include, but are not limited to, sulfur-containing compounds, nitrogen-containing compounds, phosphorous-containing compounds, and esters.

As provided herein, the present extraction process separates the contaminates from the used oil through a series of extraction stages followed by a first separation process such as a distillation process to produce recycled hydrocarbons including but not limited to recycled PAO that can be reintroduced into one or more applications described herein and without the steps of collecting different types of oil and/or burning the used oil for energy or as an energy source. Optionally, a second separation process referred to herein as a solvent recovery process provides a recovered solvent that can be returned for use in the extraction process.

The present process is a liquid-liquid extraction where contaminates in the used oil or diluted used oil are extracted from one liquid phase (the used oil) into another liquid phase referred to as an extract phase or a rich solvent phase. Liquid-liquid extraction is a chemical technique and can be applied on a small scale in laboratories using, for example, a separatory funnel, to an industrial scale using, for example, separation/distillation tower. The process also includes adding a diluent to the used oil. The diluents can be a light alkane. For example $C_6$, $C_7$, $C_8$, $C_9$, or gasoline, diesel or any hydrocarbon solvents. The diluent mixes well with the use oil. It functions as reducing viscosity of used oil, or density, to increase the extraction efficiency. The amount of diluent in used oil should be at least 10%, but no more than 90%. The diluent will mix with used oil, but not miscible with extraction solvent (NMP), and can be removed from stripping or distillation afterwards.

In the present extraction process, a liquid phase or a fraction that primarily contains recycled hydrocarbons is referred to as a "raffinate phase." The solvent requires sufficient solvency in the extract phase while its solubility in the raffinate is to be avoided. In addition, the solvent typically has a higher density than the raffinate phase. The solvent also has a relatively low boiling point to aid in recovery and recycling of the solvent. Several highly polar materials can be used as a solvent in commercial production including N-methyl pyrrolidone ("NMP"), furfural, phenol, and butanol.

Generally, the present process steps include contacting the used oil with the solvent using any known technique, including but not limited to batch contacting or counter-current contacting, preferably counter-current contacting. Counter-current contact is often conducted in an elongated treating zone or a tower which is typically vertical. In an embodiment, the used oil and/or diluted used oil is introduced at one end of an extraction unit (such as a distillation tower) while the solvent is introduced at the other end. To facilitate separation, generally, a less dense feed (or the feed is made less dense with the diluent) is introduced near the bottom of the extraction unit while the denser feed is introduced near the top of the extraction unit. In this way, the solvent and the used oil are forced to pass in a counter-current manner to each other while migrating to an end opposite of the feed end of the extraction unit and in response to respective densities. The contaminants are then absorbed into the solvent.

When utilizing NMP, the solvent is introduced near the top of the tower (or other type of extraction unit) while the used oil is introduced near the bottom. In an embodiment, the used oil is introduced at a temperature in the range 20 to 200° C., preferably 40 to 90° C., while the solvent (i.e., NMP), introduced at a temperature in the range 30 to 200° C., preferably about 40 to 90° C.

Overall temperature of the extraction unit is below the temperature of complete miscibility of oil in solvent. However, counter-current extraction using the solvent can be conducted under conditions such that there is no temperature differential between the top and bottom of the extraction unit.

The solvent, preferably NMP, is added in an amount within the range of 0.1-10 solvent to feed weight ratio, preferably 0.5-3.5 solvent to feed weight ratio.

Separation of the contaminates in the high performance lubricant is performed by countercurrent extraction in an extraction unit comprising a vertical tower having multiple stages. A used oil feed enters the extraction unit on the side of an extraction unit. An extraction solvent enters near the top and flows down the extraction unit due to its higher density. In an embodiment, a series of rotating-disk contactors and baffles optionally drive intimate contact between rising hydrocarbon and a descending solvent.

Upon exiting the tower (at its bottom), the extract phase is further processed in a solvent recovery process, essentially a separation process (i.e., a distillation process) that regenerates the solvent, making the recovered solvent available for reuse in the extraction process.

As the raffinate phase (i.e., washed PAO or other hydrocarbons) exits the extraction unit (tower), the raffinate phase will typically contain only a small amount of solvent, and or a significant amount of diluent, and both can be recovered by evaporation and/or steam stripping. In an embodiment, the raffinate phase is heated and then subject to a separation process (distillation, vacuum distillation, and the like) to remove trapped residual solvent. In an embodiment to the separation process, the solvent is flashed. At this point, the raffinate phase is relatively free of contaminates and recycled hydrocarbons (also referred to herein as "circular hydrocarbons") is available for reuse. The extent of extraction of contaminates from the used oil is dependent on operating temperatures, distillate and solvent feed rates, and solvent type.

Optionally, the raffinate phase can be under-extracted. In such aspects, the extraction is carried out under conditions such that the yield of the raffinate phase is maximized while removing most of the lowest quality molecules from the feed. Raffinate phase yield may be maximized by controlling extraction conditions, for example, by lowering the solvent to oil treat ratio and/or decreasing the extraction temperature.

In the present processes, a solvent extraction process reduces the amounts of degraded additives and oxidation byproducts and other contaminants. The solvent extraction process selectively stabilizes polar components to form a polar molecules-rich extract phase while leaving the more non-polar components in a contaminant-poor raffinate phase. By controlling the solvent to oil ratio, extraction temperature and method of contacting phases to be extracted with solvent, one can control the degree of separation between the extract and raffinate phases.

For typical used oil feeds, the contaminants are at least 2 wt. % of the total weight of the used oil and/or the base stock is 98 wt. % or less. Depending on an initial concentration of contaminants in the used oil, prior to distillation, the raffinate phase comprises at least 80 wt. % to 100 wt. % circular hydrocarbons. In an embodiment, the yield of the circular hydrocarbons of the present extraction process is at least 95 wt. %.

The circular hydrocarbon produced by the present process is suitable for use in the high performance lubricant described herein. Circular hydrocarbons have a viscosity index of at least 120, or at least 130, or at least 140, or at least 150. The viscosity index of the circular hydrocarbons can be determined according to ASTM D2270. The circular hydrocarbons have a pour point of −15° C. or less, or −20° C. or less, or −25° C. or less, depending on the nature of the high performance lubricant (i.e., wind turbine gear oil). Pour points can be determined according to ASTM D97.

In an embodiment, at least 10 wt. % of the used high performance lubricant (or at least 25 wt %, or at least 50 wt %) corresponds to a Group IV base stock having a kinematic viscosity at 100° C. of at least 4 cSt, or at least 6 cSt, or at least 10 cSt, or at least 40 cSt, or at least 60 cSt, or at least 100 cSt, such as up to 300 cSt or more.

Additionally or alternately, the base stock produced in the present process has a kinematic viscosity at 40° C. of at least 15 cSt, or at least 20 cSt, or at least 200 cSt, or at least 1000 cSt, such as up to 3500 cSt or more. Kinematic viscosity can be determined according to ASTM D445.

Additionally or alternately, the amount of esters in the circular hydrocarbons is about 5 wt. % or less, or about 2 wt. % or less or about 1 wt. % or less or about 0.5 wt. % or less, or about 0.1 wt. % or less. Ester content can be determined by FTIR.

Additionally or alternately, the amount of nitrogen in the circular hydrocarbons is about 100 ppm or less, or about 50 ppm or less, or about 20 ppm or less, or about 10 ppm or less, or 5 ppm or less. In an embodiment, nitrogen content can be determined according to AM-S1208.

Additionally or alternately, the amount of phosphorous in the circular hydrocarbons is about 100 ppm or less, or about 50 ppm or less or about 20 ppm or less, or about 10 ppm or less, or about 5 ppm or less. Phosphorous content can be determined according to D5185.

Additionally or alternately, the amount of oxygen in the circular hydrocarbons can be about 0.5 wt. % or less, or about 0.25 wt. % or less, or about 0.1 wt. % or less, or about 0.01 wt. % or less or about 0.001 wt. % or less. Oxygen content can be determined according to AM-I1776.

The features of the disclosure are described in the following non-limiting examples.

EXAMPLES

Example 1

Thermodynamic Modeling of the Extraction Process

As described herein, a liquid-liquid extraction process was tested and modeled whereby the solvent (a polar solvent, NMP) was mixed with the used oil to separate contaminates from the used oil. Once the used oil contacted the solvent, two phases were formed: a raffinate phase and an extract phase. The extract phase contains the solvent and extracted material (contaminates). In each extraction stage, fresh solvent was mixed with the raffinate phase and additional contaminates extracted, purifying the used oil comprising circular hydrocarbons such as PAO and lowering the concentration of the contaminates in the used oil.

By altering temperature and pressure, we found that the effectiveness of contaminant removal using the solvent extraction process can be optimized. Further, by altering the solvent, the adsorption of the contaminants in the raffinate phase can be changed and the number of extraction stages optimized.

In the tested methodology, the used oil was contacted with the solvent, N-methyl-2-pyrrolidone ("NMP") at a solvent/feed (S/F) ratio of 1:1 at room temperature (25° C.) and ambient pressure (1 bar). The raffinate phase and the extract phase were separated, and two additional extraction stages were performed on the raffinate phase using fresh solvent (NMP) at each stage.

As provided in Table 2, tests to determine the efficacy of contaminant removal (ester and other heteroatom-containing additives) in the extraction process for each extraction stage were performed on neat (virgin) oil and the used oil. Ester content was determined by FTIR absorbance measurement at 1741 $cm^{-1}$ with an extinction coefficient of 234.776. The ester content of the neat oil is 12 wt. %. The values for the ester content were then estimated for additional samples by calculating the ratio between the absorbance of a sample and the absorbance of the neat oil. The amount of nitrogen in ppm, phosphorous in ppm and oxygen (wt. %) were determined by AM-S1208, D5185 and AM-I1776 tests, respectively.

Table 3 provides the results of the experiments that had a reduction in the contaminates when NMP was used as in the extraction process and where polar molecules (contaminates) were extracted from the used oil.

TABLE 3

| Sample | Ester Absorbance | Ester (wt. %) | Nitrogen, ppm AM-S1208 | Phosphorous, ppm D5185 | Oxygen, % AM-I1776 |
|---|---|---|---|---|---|
| Neat Oil | 2.668 | 12 | 389 | 405 | 1.6% |
| Used Oil | 2.616 | 11.8 | 328 | 320 | 1.69% |
| NMP Extraction #1 | 1.424 | 6.4 | 165 | 61.3 | 0.97% |
| NMP Extraction #2 | 0.730 | 3.3 | 80.8 | 64.3 | 0.50% |
| NMP Extraction #3 | 0.387 | 1.7 | 60.1 | 39.5 | 0.35% |

In each of the three extractions, NMP removed approximately 50% of the ester and other heteroatom-containing additives (see FIGURE). Continuing with additional extraction stages, the eighth ($8^{th}$) extraction is predicted to result in a 99% pure hydrocarbon, the twelfth ($12^{th}$) extraction resulting in 99.9% purity, and the fifteenth ($15^{th}$) extraction in 99.99% purity.

Using the bench-scale experiments presented in Table 1, a thermodynamic model was validated using di-isotrideyl adipate (Di-iC13-ADPT) as proxy for ester contaminants. The model can accurately predict the percent removal of the Di-iC13-ADPT as observed in the laboratory test for the 3-stage extractions. This thermodynamic model formed a basis for the simulated process design described in Example 2.

We also performed a single extraction test using methanol as the solvent (at room temperature and ambient pressure) which resulted in a less effective removal of the contaminants. It took three hours longer for the methanol to separate from the used oil than the NMP, it also only removed 21% of the ester in the first extraction compared to the 46% removed by NMP in the first extraction (due to the time and poor performance, further data was not collected).

Example 2

Simulated Extraction Process

To demonstrate the efficacy of the process, a simulated extraction process for recycling used WTGO through liquid-liquid extraction was performed using the thermodynamic model developed in Example 1. The used oil was a mixture of PAOs, Di-iC13-ADPT, and decanal (C10-al), a proxy for oxidation products.

In the extraction process, the used oil (WTGO) comprised approximately 86.1 wt. % PAO, 12.9 wt. % of Di-iC13-ADPT and 1.0 wt. % of C10-al was contacted with NMP. The S/F ratio was 3.5 wt/wt and the mixture is heated to 45° C. at 1 bara. The liquid-liquid extraction process was repeated five times. After the five extractions, distillation or vacuum distillation was required to remove a residual solvent that is trapped within the raffinate phase.

The raffinate phase was heated to 250° C. and directed to a distillation column to remove residual NMP. The raffinate phase was distilled at temperatures ranging from 146° C. to 408° C. at 0.2 bara in the distillation column containing eight (8) trays. Distillation of the raffinate phase produced a flashed NMP and a circular PAO. The flashed NMP contained approximately 100 wt. % of NMP and 2.4 ppmw of C10-al. The circular PAO contained 99.97 wt. % of PAO, 202 ppmw of Di-iC13-ADPT (a di-ester), 0 wt. % of C10-al and 62 ppmw of NMP.

Likewise, the distillation process regenerated the solvent, making the recovered solvent available for reuse in the extraction process. The extracted phase (rich solvent) was heated to 250° C. and directed to a distillation column containing seven (7) trays for recovery of the solvent NMP. In the distillation column, the extracted phase was distilled at temperatures ranging from 203° C. to 264° C. at 1 bara to produce a stream of recovered NMP and a contaminant distillate. The recovered NMP stream contained approximately 99.7 wt. % of NMP and 0.29 ppm of C10-al. The contaminant distillate comprised 100 wt. % of Di-iC13-ADPT.

Table 2 provides key process metrics of the extraction process described in this Example 2.

TABLE 2

| Extraction Performance Metric | Value |
|---|---|
| % Removal Di-iC13-ADPT (di-isotridecyl adipate) | 99.87 wt. % |
| % Removal C10-al (decanal) | 100 wt. % |
| PAO final purity (distilled raffinate) | 99.97 wt. % |
| NMP in distilled raffinate | 62 ppmw |
| Recovered NMP purity | 99.7 wt. % |

Example 3

Continuous Counter Current Extraction Process

To further confirm the lab-scale extraction and simulated extraction results, a multi-stage counter current extraction pilot plant unit was used to extract a used oil sample at refinery relevant conditions. The typical extraction condition are as the following: tower bottom temperature 60-105° C. with a temperature gradient of 15 degrees from bottom to top. The treating ratio (v/v NMP/oil) is 150%-400%, with 1-5% of water in NMP. Used oil (light phase) enters the column from the bottom and flow to the top, and NMP solvent (dense phase) enters from the top and flow to the bottom. The two phases are mixed in the counter current extraction column. The extract phase NMP enriched with contaminant leaves the column via an outlet at the bottom, and the raffinate phase of cleaned PAO leaves via an outlet at the top. After extraction, the solvent is stripped with a vacuum to get the recycled PAO. The test results are the following:

| Exp. # | Used Oil | A | B | C | D |
|---|---|---|---|---|---|
| Condition (T, treat ratio) | — | 60 C., 178% | 60 C., 270% | 80 C., 143% | 80 C., 249% |
| P, ppm, D5185 | 295 | 151 | 147 | 91 | 91 |
| Zn, ppm, D5158 | 31 | 23 | 22 | 20 | 19 |
| S, ppm, D5185 | 2879 | 1569 | 1575 | 985 | 1086 |
| O, %, M1776 | 2.09 | 1.49 | 1.47 | 1.2 | 1.16 |
| KV100, cSt, D445 | 39.59 | 46.25 | 46.96 | 50.18 | 51.07 |

Example 4

Used oil is diluted with 50 vol % a diluent heptane, and then subject to the extraction at 30-70 C extraction, the extraction efficiency is much improved to 98+% or 99+%.

| Exp. # | Feed | A | B |
|---|---|---|---|
| Condition (T, treat ratio) | N/A | 30 C., 150% | 70 C., 150% |
| P, ppm, D5185 | 380 | 24.9 | 5.99 |
| Zn, ppm, D5158 | 9.51 | <2.0 | <2.0 |
| Si, ppm, D5158 | 19 | <2.0 | <2.0 |
| S, ppm, D5185 | 3163 | 241 | 89 |
| O, %, M1776 | 2.11 | 1.11 | <0.3 |
| KV100, cSt, D445 | — | 47.19 | 48.24 |
| VI, D2270 | — | 165 | 166 |

ADDITIONAL EMBODIMENTS

Additionally, or alternately, the invention relates to:

Embodiment 1. A process for recycling hydrocarbons in a used wind turbine gear oil comprising a hydrocarbon and a contaminate, the process comprising the steps of:

a) contacting the used wind turbine gear oil with a liquid phase;

b) extracting the contaminate from the used oil into an extract phase;

c) repeat steps a) and b) at least three times to remove the contaminate from the used oil;

d) separating the extract phase and a raffinate phase; and e) separating the liquid phase from the raffinate phase to form a circular hydrocarbon; and f) blending the circular hydrocarbon with one or more base stocks to provide a high performance lubricant.

Embodiment 2. The process for recycling hydrocarbons of embodiment 1, wherein the used wind turbine gear oil is diluted with a first solvent, different from the liquid phase.

Embodiment 3. The process for recycling hydrocarbons of embodiment 1, wherein the contaminate is selected from degraded additives and oxidation by-products.

Embodiment 4. The process of recycling hydrocarbons of embodiment 1, wherein the process is continuous.

Embodiment 5. The process of recycling hydrocarbons of embodiment 1, wherein the raffinate phase comprises the circular hydrocarbon.

Embodiment 6. The process of recycling hydrocarbons of embodiment 5, wherein the circular hydrocarbons have a viscosity index of at least 115 and a pour point of −15° C. or less.

Embodiment 7. The process of recycling hydrocarbons of embodiment 1, wherein the wind turbine gear oil comprises between 65 percent and 95 percent polyalphaolefin.

Embodiment 8. The process of recycling hydrocarbons of embodiment 1, wherein the contaminates comprise degraded additives.

Embodiment 9. The process for recycling hydrocarbons of embodiment 1, wherein the liquid phase is a second solvent.

Embodiment 10. The process of recycling hydrocarbons of embodiment 9, wherein the solvent is NMP and the dilutant is $C_7$ heptane.

Embodiment 11. The process of recycling hydrocarbons of embodiment 9, further comprising the steps of recovering the solvent from the extract phase, and recovering the diluent from the raffinate phase.

Embodiment 12. A method of recycling hydrocarbons from a used high performance lubricant comprising the steps of:

providing the used high performance lubricant, diluted with a first solvent that is miscible with the used high performance lubricant without phase separation and which can be removed with distillation, to a multi-stage liquid-liquid extraction unit, wherein the extraction unit comprises at least 5 stages of liquid-liquid extraction;

mixing the used high performance lubricant with a second solvent wherein two immiscible phases of liquid are produced;

separating the immiscible phases of liquid into an extract phase and a raffinate phase wherein the raffinate phase comprises a circular hydrocarbon;

separating the circular hydrocarbon from the solvent in the raffinate phase to produce an extraction product; and combining the extraction product with a high performance base stock.

Embodiment 13. The method of recycling hydrocarbons from a used high performance lubricant of embodiment 12, wherein the circular hydrocarbon is a polyalphaolefin.

Embodiment 14. The method of recycling hydrocarbons from a used high performance lubricant of embodiment 12, wherein the raffinate phase comprises 2.0 to 10.0 percent solvent.

Embodiment 15. The method of recycling hydrocarbons from a used high performance lubricant of embodiment 12, wherein the first solvent is a $C_7$ solvent in an amount ranging from 10-90 wt %.

Embodiment 16. The method of recycling hydrocarbons of embodiment 15, wherein the extraction product has a viscosity index of at least 115 and a pour point of −15° C. or less.

Embodiment 17. The process of recycling hydrocarbons of embodiment 12, wherein the used high performance lubricant comprises degraded additives and/or anti-wear compounds.

Embodiment 18. The process of recycling hydrocarbons of embodiment 12, wherein the solvent is NMP, and the diluent is a hydrocarbon of $C_6$-$C_{12}$.

Embodiment 19. The process of recycling hydrocarbons of embodiment 12, further comprising the step of recovering the first solvent from the raffinate phase and the $2^{nd}$ solvent from the extract phase.

Embodiment 20. The process of recycling hydrocarbons of embodiment 12, wherein the extraction product has a purity of 99.97 wt. %.

Many alterations, modifications, and variations will be apparent to those skilled in the art in light of the foregoing description without departing from the spirit or scope of the present disclosure and that when numerical lower limits and numerical upper limits are listed herein, ranges from any lower limit to any upper limit are contemplated.

The invention claimed is:

1. A process for recycling hydrocarbons in a used wind turbine gear oil comprising a hydrocarbon and a contaminate, the process comprising the steps of:

a) contacting, via counter-current contact, the used wind turbine gear oil with a liquid phase;

b) extracting, via liquid-liquid extraction, the contaminate from the used wind turbine gear oil into an extract phase;

c) repeat steps a) and b) at least three times to remove the contaminate from the used wind turbine gear oil;

d) separating the extract phase and a raffinate phase;

e) separating the liquid phase from the raffinate phase to form a circular hydrocarbon; and f) blending the circular hydrocarbon with one or more base stocks to provide a high performance lubricant.

2. The process for recycling hydrocarbons of claim 1, wherein the used wind turbine gear oil is diluted with a first solvent, which dissolves with used oil into a single liquid phase.

3. The process for recycling hydrocarbons of claim 1, wherein the contaminate is selected from degraded additives and oxidation by-products.

4. The process of recycling hydrocarbons of claim 1, wherein the process is continuous.

5. The process of recycling hydrocarbons of claim 1, wherein the raffinate phase comprises the circular hydrocarbon.

6. The process of recycling hydrocarbons of claim 5, wherein the circular hydrocarbons have a viscosity index of at least 115 and a pour point of −15° C. or less.

7. The process of recycling hydrocarbons of claim 1, wherein the used wind turbine gear oil comprises between 65 percent and 95 percent polyalphaolefin.

8. The process of recycling hydrocarbons of claim 1, wherein the liquid phase comprises a solvent and a diluent, and wherein the solvent is N-methyl pyrrolidone (NMP) and the diluent is C7 heptane.

9. The process of recycling hydrocarbons of claim 8, further comprising the steps of recovering the solvent from the extract phase, and recovering the diluent from the raffinate phase.

10. The process of recycling hydrocarbons of claim 1, wherein the liquid phase is N-methyl pyrrolidone (NMP).

11. The process of recycling hydrocarbons of claim 10, wherein NMP is configured to remove at least 50% of ester from the used wind turbine gear oil in each repeat of steps a) and b).

12. The process of recycling hydrocarbons of claim 1, comprising repeat steps a) and b) five times to remove the contaminate from the used wind turbine gear oil.

* * * * *